US008216400B2

(12) United States Patent
Kumagai

(10) Patent No.: US 8,216,400 B2
(45) Date of Patent: Jul. 10, 2012

(54) HIGH-STRENGTH STEEL PLATE AND PRODUCING METHOD THEREFOR

(75) Inventor: Tatsuya Kumagai, Tokyo (JP)

(73) Assignee: Nippon Steel Corporation, Tokyo (JP)

( * ) Notice: Subject to any disclaimer, the term of this patent is extended or adjusted under 35 U.S.C. 154(b) by 0 days.

(21) Appl. No.: 12/681,853

(22) PCT Filed: Sep. 14, 2009

(86) PCT No.: PCT/JP2009/004583

§ 371 (c)(1),
(2), (4) Date: Apr. 6, 2010

(87) PCT Pub. No.: WO2010/032428

PCT Pub. Date: Mar. 25, 2010

(65) Prior Publication Data

US 2010/0230016 A1 Sep. 16, 2010

(30) Foreign Application Priority Data

Sep. 17, 2008 (JP) ..... P2008-237264

(51) Int. Cl.
*C21D 7/00* (2006.01)
*C21D 8/02* (2006.01)
*C22C 38/00* (2006.01)

(52) U.S. Cl. ..... 148/663; 148/337; 148/332; 148/330; 148/645; 420/103; 420/119; 420/112; 420/92

(58) Field of Classification Search ..... 148/320, 148/663, 547, 645; 420/103, 119, 112, 92
See application file for complete search history.

(56) References Cited

U.S. PATENT DOCUMENTS 7,048,810 B2 * 5/2006 Petersen et al. ..... 148/320

(Continued)

FOREIGN PATENT DOCUMENTS

EP 1 375 681 A2 1/2004

(Continued)

OTHER PUBLICATIONS

NPL-1: ASTM E112-96 (2004) Table 4—Grain size Relationships.*

(Continued)

*Primary Examiner* — Jie Yang
(74) *Attorney, Agent, or Firm* — Birch, Stewart, Kolasch & Birch, LLP

(57) ABSTRACT

A high-strength steel plate includes the following composition: 0.18 to 0.23 mass % of C; 0.1 to 0.5 mass % of Si; 1.0 to 2.0 mass % of Mn; 0.020 mass % or less of P; 0.010 mass % or less of S; 0.5 to 3.0 mass % of Ni; 0.003 to 0.10 mass % of Nb; 0.05 to 0.15 mass % of Al; 0.0003 to 0.0030 mass % of B; 0.006 mass % or less of N; and a balance composed of Fe and inevitable impurities. A weld crack sensitivity index Pcm of the high-strength steel plate is 0.36 mass % or less. The $A_{c3}$ transformation point is equal to or less than 830° C., the percentage value of a martensite structure is equal to or greater than 90%, the yield strength is equal to or greater than 1300 MPa, and the tensile strength is equal to or greater than 1400 MPa and equal to or less than 1650 MPa. A prior austenite grain size number Nγ is calculated by $N\gamma=-3+\log_2 m$ using an average number m of crystal grains per 1 $mm^2$ in a cross section of a sample piece of the high-strength steel plate. If the tensile strength is less than 1550 MPa, the prior austenite grain size number Nγ satisfies the formulae $N\gamma \geqq ([TS]-1400)\times 0.004+8.0$ and $N\gamma \geqq 11.0$, and if the tensile strength is equal to or greater than 1550 MPa, the prior austenite grain size number Nγ satisfies the formulae $N\gamma \geqq ([TS]-1550)\times 0.008+8.6$ and $N\gamma \leqq 11.0$, where [TS] (MPa) is the tensile strength.

7 Claims, 4 Drawing Sheets

Pcm=[C]+[Si]/30+[Mn]/20+[Cu]/20+[Ni]/60+[Cr]/20+[Mo]/15+[V]/10+5[B], WHERE [C], [Si], [Mn], [Cu], [Cu], [Ni], [Cr], [Mo], [V], AND [B] ARE THE CONCENTRATIONS (MASS%) OF C, Si, Mn, Cu, Ni, Cr, Mo, V, AND B, RESPECTIVELY.

U.S. PATENT DOCUMENTS

2008/0110535 A1* 5/2008 Oi et al. ..... 148/663

FOREIGN PATENT DOCUMENTS

| | | | |
|---|---|---|---|
| JP | 1-149921 | A | 6/1989 |
| JP | 2-236223 | A | 9/1990 |
| JP | 7-90488 | A | 4/1995 |
| JP | 9-263876 | A | 10/1997 |
| JP | 11-71631 | A | 3/1999 |
| JP | 11-80903 | A | 3/1999 |
| JP | 11-229075 | A | 8/1999 |
| JP | 2007-302974 | A | 11/2007 |
| JP | 2008-208454 | A | 9/2008 |

OTHER PUBLICATIONS

Extended European Search Report dated May 25, 2011 in application No. EP 09 81 4273.

Ozgowicz et al., "Investigations on the impact strength of constructional high-strength Weldox steel at lowered temperature", Archives of Materials Science and Engineering [online], vol. 32, No. 2, Aug. 1, 2008, pp. 89-94, XP002636128.

SSAB: "Weldox 1300", Chemical composition (ladle analysis), Oct. 15, 2005, retrieved from the internet: URL:http://www.ssab.com/Global/WELDOX/Data sheets/en/144_WELDOX_1300_UK_Special%20Data%20Sheet.pdf.

* cited by examiner

Pcm=[C]+[Si]/30+[Mn]/20+[Cu]/20+[Ni]/60+[Cr]/20+[Mo]/15+[V]/10+5[B], WHERE [C], [Si], [Mn], [Cu], [Cu], [Ni], [Cr], [Mo], [V], AND [B] ARE THE CONCENTRATIONS (MASS%) OF C, Si, Mn, Cu, Ni, Cr, Mo, V, AND B, RESPECTIVELY.

HIGH-STRENGTH STEEL PLATE AND PRODUCING METHOD THEREFOR

BACKGROUND OF THE INVENTION

1. Field of the Invention

The present invention relates to a high-strength steel plate which is used as a structural member of a construction machine or an industrial machine, has excellent delayed fracture resistance, bending workability, and weldability, has high strength of a yield strength equal to or greater than 1300 MPa and a tensile strength equal to or greater than 1400 MPa, and has a plate thickness equal to or greater than 4.5 mm and equal to or smaller than 25 mm; and a producing method therefor.

Priority is claimed on Japanese Patent Application No. 2008-237264 filed on Sep. 17, 2008, the content of which is incorporated herein by reference.

2. Description of Related Art

In recent years, with the worldwide construction demand, the production of construction machines such as cranes and concrete pumping vehicles has increased, and simultaneously, the size of these construction machines has continued to increase. In order to suppress an increase in weight due to the increase in size of the construction machine, demand for a lightweight structural member has increased, so that a change to high-strength steel having a yield strength of 900 to 1100 MPa-class is taking place. Recently, demand for a steel plate for a structural member having a yield strength of 1300 MPa or greater (and a tensile strength of 1400 MPa or greater, preferably, 1400 to 1650 MPa) has increased.

In general, when the tensile strength increases over 1200 MPa, there is a possibility that delayed fracture due to hydrogen may occur. Accordingly, in particular, a steel plate having a yield strength of 1300 MPa-class (and a tensile strength of 1400 MPa-class) requires a high delayed fracture resistance. In addition, the steel plate that has a high strength is disadvantageous in terms of usability such as bending workability and weldability. Therefore, the steel plate requires usability that is not much lower than an existing high-strength steel of 1100 MPa-class.

As a technique related to a steel plate for a structural member having a yield strength of 1300 MPa-class, a producing method for a steel plate which has a tensile strength of 1370 to 1960 N/mm$^2$-class and has excellent hydrogen embrittlement resistance is disclosed in, for example, Japanese Unexamined Patent Application, First Publication No. H7-90488. However, the technique disclosed in Japanese Unexamined Patent Application, First Publication No. H7-90488 is related to a cold-rolled steel plate having a thickness of 1.8 mm and is premised on a high cooling rate of 70° C./s or greater, so that the technique does not consider weldability.

Hitherto, as a technique for enhancing a delayed fracture resistance of high-strength steel, there has been known a technique of refining grain size. Techniques of Japanese Unexamined Patent Application, First Publication No. H11-80903 and Japanese Unexamined Patent Application, First Publication No. 2007-302974 are examples of this technique. However, in the examples, in order to enhance the delayed fracture resistance, the prior austenite grain size needs to be equal to or smaller than 5 μm (Japanese Unexamined Patent Application, First Publication No. H11-80903) and equal to or smaller than 7 μm (Japanese Unexamined Patent Application, First Publication No. 2007-302974). However, it is not easy to refine the grain size of a steel plate down to such a size by a normal production process. Both the techniques disclosed in Japanese Unexamined Patent Application, First Publication No. H11-80903 and Japanese Unexamined Patent Application, First Publication No. 2007-302974 are techniques for refining a prior austenite grain size through rapid heating before quenching. However, in order to rapidly heat the steel plate, special heating equipment is needed, so that it is difficult to implement either technique. In addition, due to the grain refining, hardenability is degraded. Therefore, in order to ensure the strength, additional alloy elements are needed. Accordingly, an excessive grain refining is not preferable in terms of weldability and economic efficiency.

For the purpose of wear resistance, a steel member having a high strength corresponding to a yield strength of 1300 MPa-class has been widely used, and there are examples of a steel member taking delayed fracture resistance into consideration. For example, wear-resistant steels having excellent delayed fracture resistance are disclosed in Japanese Unexamined Patent Application, First Publication No. H11-229075 and Japanese Unexamined Patent Application, First Publication No. H1-149921. The tensile strengths of the wear-resistant steels disclosed in Japanese Unexamined Patent Application, First Publication No. H11-229075 and Japanese Unexamined Patent Application, First Publication No. H1-149921 are in the ranges of 1400 to 1500 MPa and 1450 to 1600 MPa, respectively. However, in Japanese Unexamined Patent Application, First Publication No. H11-229075 and Japanese Unexamined Patent Application, First Publication No. H1-149921, there is no mention of yield stress. With regard to wear resistance, hardness is an important factor, so that the tensile strength has an effect on the wear resistance. However, since the yield strength does not have a significant effect on the wear resistance, the wear-resistant steel does not generally take the yield strength into consideration. Therefore, the wear-resistant steel is considered to be unsuitable as a structural member of a construction machine or an industrial machine.

In Japanese Unexamined Patent Application, First Publication No. H9-263876, a high-strength bolt steel member that has a yield strength of 1300 MPa-class is provided with enhanced delayed fracture resistance by elongation of prior austenite grains and rapid-heating tempering. However, the rapid-heating tempering cannot be easily performed in existing plate heat treatment equipment, so that it cannot be easily applied to a steel plate.

As described above, the existing technique is not enough to economically obtain a high-strength steel plate for a structural member, which has a yield strength of 1300 MPa or greater and a tensile strength of 1400 MPa or greater, and has delayed fracture resistance or usability such as bending workability and weldability.

SUMMARY OF THE INVENTION

An object of the present invention is to provide a high-strength steel plate for a structural member, which is used as a structural member of a construction machine or an industrial machine, has excellent delayed fracture resistance, bending workability, and weldability, and has a yield strength of 1300 MPa or greater and a tensile strength of 1400 MPa or greater, and a producing method therefor.

The most economical way to obtain a high strength such as a yield strength of 1300 MPa or greater and a tensile strength of 1400 MPa or greater is to perform quenching from a fixed temperature so as to transform a structure of steel to martensite. In order to obtain a martensite structure, suitable hardenability and a suitable cooling rate are needed for steel. The thickness of a steel plate used as a structural member of a construction machine or an industrial machine is generally equal to or smaller than 25 mm. When the thickness thereof is 25 mm, during quenching using general steel plate cooling equipment, under a water-cooling condition of a water amount density of about 1 $m^3/m^2 \cdot min$, an average cooling rate at a center portion of the plate thickness is equal to or greater than 20° C./s. Therefore, the composition of steel needs to be controlled so that the steel exhibits sufficient hardenability to have a martensite structure at a cooling rate of 20° C./s or greater. The martensite structure of the present invention is considered to be a structure almost corresponding to full martensite after quenching. Specifically, the fraction (percentage value) of martensite structure is 90% or greater, and a fraction of structures such as retained austenite, ferrite, and bainite except for martensite is less than 10%. When the fraction of the martensite structure is low, in order to obtain a predetermined strength, additional alloy elements are needed.

In order to enhance hardenability and strength, a large amount of alloy elements may be added. However, when the amount of the alloy elements is increased, weldability is degraded. The inventor examined the relationship between a weld crack sensitivity index Pcm and a preheating temperature by conducting a y-groove weld cracking test specified by JIS Z 3158 on various steel plates which have thickness of 25 mm, prior austenite grain size numbers of 8 to 11, yield strengths of 1300 MPa or greater, and tensile strengths of 1400 MPa or greater. Results of the test are shown in FIG. 1. In order to reduce a load during welding, it is preferable that the preheating temperature be as low as possible. Here, the aim is to enable a cracking prevention preheating temperature, that is, a preheating temperature at which a root crack ratio is 0, to be 150° C. or less when the plate thickness is 25 mm. In FIG. 1, in order to reduce the root crack ratio completely to zero at a preheating temperature of 150° C., the weld crack sensitivity index Pcm is 0.36% or less, and the index Pcm is used as an upper limit of an amount of alloy to be added.

A weld crack is mainly influenced by the preheating temperature. FIG. 1 shows the relationship between the weld crack and the preheating temperature. As described above, in order to prevent the root crack completely at a preheating temperature of 150° C., the index Pcm needs to be 0.36% or less. In order to prevent the root crack completely at a preheating temperature of 125° C., the index Pcm needs to be 0.34% or less.

Delayed fracture resistance of a martensitic steel significantly depends on the strength. When the tensile strength is greater than 1200 MPa, there is a possibility that a delayed fracture may occur. Moreover, sensitivity to the delayed fracture increases depending on the strength. As a means for enhancing delayed fracture resistance of the martensitic steel, there is a method of refining a prior austenite grain size as described above. However, since the hardenability is degraded with the grain refining, in order to ensure strength, a larger amount of alloy elements is needed. Therefore, in terms of weldability and economic efficiency, an excessive grain refining is not preferable.

The inventor investigated effects of the strength, particularly, the tensile strength of the steel plate and the prior austenite grain size on the delayed fracture resistance of the martensitic steel in detail. As a result, it was found that by controlling the tensile strength and the prior austenite grain size to be in predetermined ranges, it is possible to ensure the delayed fracture resistance and sufficient hardenability to reliably obtain a martensite structure even under a condition where the amount of alloy elements is suppressed. A specific control range will be described as follows.

Evaluation of delayed fracture resistance was performed using "critical diffusible hydrogen content" which is an upper limit of a hydrogen content at which steel is not fractured in a delayed fracture test. This method is disclosed in Tetsu-to-Hagané, Vol. 83 (1997), p. 454. Specifically, various contents of diffusible hydrogen were allowed to be contained in samples through electrolytic hydrogen charging in notched specimens (round bars) having a shape illustrated in FIG. 2 and plating was performed on surfaces of the specimens to prevent hydrogen from dispersing. The specimens were held in the air while being applied with a predetermined load, and a time until a delayed fracture occurred was measured. The load stress in the delayed fracture test was set to be 0.8 times the tensile strength of the steels. FIG. 3 shows an example of a relationship between the diffusible hydrogen content and a fracture time taken until a delayed fracture occurs. As the amount of diffusible hydrogen contained in the specimen decreases, the time until a delayed fracture occurs increases. In addition, when the content of diffusible hydrogen is equal to or smaller than a predetermined value, a delayed fracture does not occur. Immediately after the delayed fracture test, the hydrogen content (integral value) of the specimen was measured using gas chromatography while being heated at a rate of 100° C./h to 400° C. The hydrogen content (integral value) is defined as "diffusible hydrogen content". In addition, a limit of the hydrogen content at which the specimen is not fractured is defined as "critical diffusible hydrogen content Hc".

On the other hand, a hydrogen content absorbed into the steel from the environment is changed due to metallurgical factors of the steel. In order to evaluate the absorbed hydrogen content, a corrosion acceleration test was performed. In the test, repetition of drying and wetting was performed for 30 days at a cycle shown in FIG. 4 using a solution of 5 mass % NaCl. After the test, the hydrogen content (an integral value) absorbed into the steel is defined as "diffusible hydrogen content absorbed from the environment HE", the hydrogen content being measured using gas chromatography under the same rising temperature condition used for measuring the diffusible hydrogen content. When the "critical diffusible hydrogen content Hc" is relatively sufficiently greater than the "diffusible hydrogen content absorbed from the environment HE", it is thought that sensitivity to delayed fractures is low. When the Hc/HE is greater than 3, sensitivity to delayed fractures is determined to be low and delayed fracture resistance is determined to be good.

The inventor evaluated sensitivity to delayed fractures of the martensitic steel of which the tensile strength and the prior austenite grain size were changed by the above-described method. The prior austenite grain size was evaluated by a prior austenite grain size number. Results thereof are shown in FIG. 5. In FIG. 5, steels which satisfy the Hc/HE>3 are represented by a open circle (○), and steels which satisfy Hc/HE≦3 are represented by a cross (×). In FIG. 5, it can be seen that the sensitivity to delayed fractures is classified well by the tensile strength and the prior austenite grain size number (Nγ). That is, it can be seen that the delayed fracture resistance can be reliably enhanced by controlling both the tensile strength and the prior austenite grain size.

Referring to FIG. 5, at or above a tensile strength of 1400 MPa, in order to reliably satisfy Hc/HE>3, which represents a low sensitivity to a delayed fracture (there is no case satisfying Hc/HE≦3), the following relationship has to be satisfied. That is, in a case where the tensile strength is equal to or greater than 1400 MPa and less than 1550 MPa, $N\gamma \geqq ([TS]-1400)\times 0.004+8.0$ is satisfied. In a case where the tensile strength is equal to or greater than 1550 MPa and equal to or lower than 1650 MPa, $N\gamma \geqq ([TS]-1550)\times 0.008+8.6$ is satisfied. Here, [TS] is a tensile strength (MPa), and $N\gamma$ is a prior austenite grain size number. The prior austenite grain size number is measured by a method of JIS G 0551 (2005) (ISO 643). That is, a prior austenite grain size number is calculated by $N\gamma=-3+\log_2 m$ using an average number m of crystal grains per 1 $mm^2$ in a cross-section of a specimen (sample piece) of the high-strength steel plate.

Grain refining is effective in reducing sensitivity to delayed fractures. However, when the grain size is decreased, hardenability is degraded, so that it is difficult to obtain a martensite structure (martensite). Therefore, in order to obtain a predetermined strength, more alloy elements are needed. In consideration of the thickness of the steel plate used as a structural member of a construction machine or an industrial machine as described above, martensite needs to be obtained at a cooling rate of about 20° C./s. In addition, when an upper limit of the weld crack sensitivity index Pcm is restricted in order to ensure the weldability, in a case where the austenite grain size is excessively refined, it is difficult to obtain martensite at this cooling rate. The inventor examined the relationship between alloy content, prior austenite grain size, and strength in various ways. As a result, it was found that under a condition in which the alloy content is set so that the weld crack sensitivity index Pcm is 0.36% or less, when the prior austenite grain size number is greater than 11.0, a martensite structure cannot be obtained at a cooling rate of 20° C./s. Moreover, in FIG. 5, even when the prior austenite grain size number is less than 11, a plot in which the tensile strength is less than 1400 MPa has a C content of less than 0.18% that is the lower limit of C according to the present invention. In addition, although the weld crack sensitivity index Pcm is equal to or less than 0.36%, in a plot in which the tensile strength is greater than 1650 MPa, the C content is greater than 0.23% that is the upper limit of C according to the present invention.

In addition, when the tensile strength is greater than 1650 MPa, bending workability is significantly degraded. Therefore, the upper limit of the tensile strength is set to 1650 MPa.

Therefore, in a tensile strength range (of 1400 to 1650 MPa) of the steel plate of the present invention, in order to enhance delayed fracture resistance, suppress the alloy element content, and reliably obtain the martensite structure, the following relationships (a) or (b) are satisfied:

(a) when the tensile strength is equal to or greater than 1400 MPa and less than 1550 MPa, the formulae $N\gamma \geqq [TS]-1400)\times 0.004+8.0$ and $N\gamma \leqq 11.0$ are satisfied, and (b) when the tensile strength is equal to or greater than 1550 MPa and equal to or less than 1650 MPa, the formulae $N\gamma \geqq ([TS]-1550)\times 0.008+8.6$ and $N\gamma \leqq 11.0$ are satisfied, where [TS] is the tensile strength (MPa), and $N\gamma$ is the prior austenite grain size number. A range that satisfies (a) or (b) is shown as an area enclosed by a heavy line segments in FIG. 5.

The strength of the martensitic steel is greatly influenced by the C content and a tempering temperature. Therefore, in order to achieve a yield strength of 1300 MPa or more and a tensile strength of 1400 MPa or more and 1650 MPa or less, the C content and the tempering temperature need to be suitably selected. FIGS. 6 and 7 show influences of the C content and the tempering temperature on the yield strength and the tensile strength of the martensitic steel.

When the martensitic steel is not subjected to tempering, that is, when the martensitic steel is in the as-quenched state, the yield ratio of the martensitic steel is low. Accordingly, the tensile strength is increased; and the yield strength is decreased. In order to increase the yield strength to 1300 MPa or more, substantially 0.24% or more of the C content is needed. However, with the C content, it is difficult to achieve a tensile strength of 1650 MPa or less.

On the other hand, in the martensite structure subjected to tempering at 450° C. or higher, the yield ratio is increased; and the tensile strength is significantly decreased. In order to ensure a tensile strength of 1400 MPa or more, substantially 0.35% or more of the C content is needed. However, with the C content, it is difficult to allow the weld crack sensitivity index Pcm to be equal to or less than 0.36% to ensure weldability.

By performing tempering of the martensitic steel at a low temperature of equal to or greater than 200° C. and equal to or less than 300° C., it is possible to increase the yield ratio without a significant decrease in the tensile strength. In this case, it is possible to satisfy a condition in which the yield strength is equal to or greater than 1300 MPa and the tensile strength is equal to or greater than 1400 MPa and equal to or less than 1650 MPa.

In addition, when tempering is performed on the martensitic steel at a temperature greater than 300° C. and less than 450° C., there is a problem in that toughness is degraded due to low-temperature tempering embrittlement. However, when the tempering temperature is equal to or greater than 200° C. and equal to or less than 300° C., tempering embrittlement does not occur, so that there is no problem with the toughness degradation.

As described above, it could be seen that by performing tempering on the martensitic steel containing a suitable C content and alloy elements at a low temperature of 200° C. or greater and 300° C. or less, it is possible to increase the yield ratio without the toughness degradation, so that a yield strength of 1300 MPa or more and a tensile strength of 1400 MPa or more and 1650 MPa or less can both be obtained.

According to the present invention, there is no need to significantly refine the prior austenite grain size. However, suitably controlling the grain size to the prior austenite grain size number that satisfies the (a) or (b) is needed. The inventor had investigated various production conditions. As a result, the inventor found that it is possible to easily and stably obtain polygonal grains which have uniform size and the prior austenite grain size number that satisfies the (a) or (b) using the following producing method. That is, a suitable content of Nb is added to a steel plate, controlled rolling is suitably performed during hot rolling, and thereby a suitable residual strain is introduced into the steel plate before quenching. Thereafter, reheat-quenching is performed in a reheating temperature range of equal to or greater than 20° C. greater than the $A_{c3}$ transformation point and equal to or less than 850° C. Transformation into austenite does not sufficiently occur at a reheating temperature a little bit higher than (immediately above) the $A_{c3}$ transformation point, and a duplex grain structure is formed, so that the average austenite grain size is refined. Therefore, the reheating temperature is set to be equal to or greater than 20° C. greater than $A_{c3}$ transformation point. FIG. 8 shows an example of a relationship between a quenching heating temperature (reheating temperature) and a prior austenite grain size. In addition, in terms of bending workability of the steel plate, grain refining of the prior austenite are effective, and when the tensile strength and the prior austenite grain size number are in the ranges of the present invention, good bending workability can be obtained.

According to these findings, it is possible to obtain a steel plate which has a yield strength of 1300 MPa or more and a tensile strength of 1400 MPa or more (preferably in the range of 1400 to 1650 MPa), has excellent delayed fracture resistance, bending workability, and weldability, and a thickness in the range of 4.5 to 25 mm.

The summary of the present invention is described as follows.

(1) A high-strength steel plate includes the following composition: 0.18 to 0.23 mass % of C, 0.1 to 0.5 mass % of Si; 1.0 to 2.0 mass % of Mn; 0.020 mass % or less of P; 0.010 mass % or less of S; 0.5 to 3.0 mass % of Ni; 0.003 to 0.10 mass % of Nb; 0.05 to 0.15 mass % of Al; 0.0003 to 0.0030 mass % of B; 0.006 mass % or less of N; and a balance composed of Fe and inevitable impurities, wherein a weld crack sensitivity index Pcm of the high-strength steel plate is calculated by Pcm=[C]+[Si]/30+[Mn]/20+[Cu]/20+[Ni]/60+[Cr]/20+[Mo]/15+[V]/10+5[B], and is 0.36 mass % or less, where [C], [Si], [Mn], [Cu], [Ni], [Cr], [Mo], [V], and [B] are the concentrations (mass %) of C, Si, Mn, Cu, Ni, Cr, Mo, V, and B, respectively, an $A_{c3}$ transformation point is equal to or less than 830° C., a percentage value of a martensite structure is equal to or greater than 90%, a yield strength is equal to or greater than 1300 MPa, and a tensile strength is equal to or greater than 1400 MPa and equal to or less than 1650 MPa, a prior austenite grain size number Nγ is calculated by $N\gamma=-3+\log_2 m$ using an average number m of crystal grains per 1 $mm^2$ in a cross section of a sample piece of the high-strength steel plate, and if the tensile strength is less than 1550 MPa, the prior austenite grain size number Nγ satisfies the formulae $N\gamma \geqq ([TS]-1400)\times 0.004+8.0$ and $N\gamma \leqq 11.0$, and if the tensile strength is equal to or greater than 1550 MPa, the prior austenite grain size number Nγ satisfies the formulae $N\gamma \geqq ([TS]-1550)\times 0.008+8.6$ and $N\gamma \leqq 11.0$, where [TS] (MPa) is the tensile strength.

(2) The high-strength steel plate described in the above (1) may further include one or more kinds selected from the group consisting of: 0.05 to 0.5 mass % of Cu; 0.05 to 1.5 mass % of Cr; 0.03 to 0.5 mass % of Mo; and 0.01 to 0.10 mass % of V.

(3) In the high-strength steel plate described in the above (1) or (2), the thickness of the high-strength steel plate may be equal to or greater than 4.5 mm and equal to or less than 25 mm.

(4) A producing method for a high-strength steel plate, the method includes: heating a slab having the composition described in the above (1) or (2) to 1100° C. or greater; performing hot rolling in which a cumulative rolling reduction is equal to or greater than 30% and equal to or less than 65% in a temperature range of equal to or less than 930° C. and equal to or greater than 860° C. and the rolling is terminated at a temperature of equal to or greater than 860° C., thereby producing a steel plate having a thickness of equal to or greater than 4.5 mm and equal to or less than 25 mm; reheating the steel plate at a temperature of equal to or greater than 20° C. greater than $A_{c3}$ transformation point and equal to or less than 850° C. after cooling; performing accelerated cooling to 200° C. or less under a cooling condition in which an average cooling rate at a plate thickness center portion of the steel plate during cooling from 600° C. to 300° C. is equal to or greater than 20° C./s; and performing tempering in a temperature range of equal to or greater than 200° C. and equal to or less than 300° C.

DETAILED DESCRIPTION OF THE INVENTION

Figure 1:
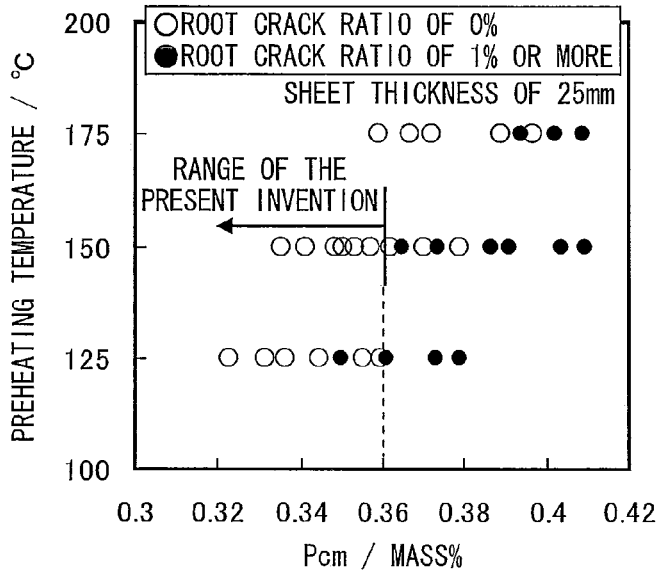
FIG. 1 is a graph showing a relationship between a weld crack sensitivity index Pcm and a cracking prevention preheating temperature in a y-groove weld cracking test.
Figure 2:
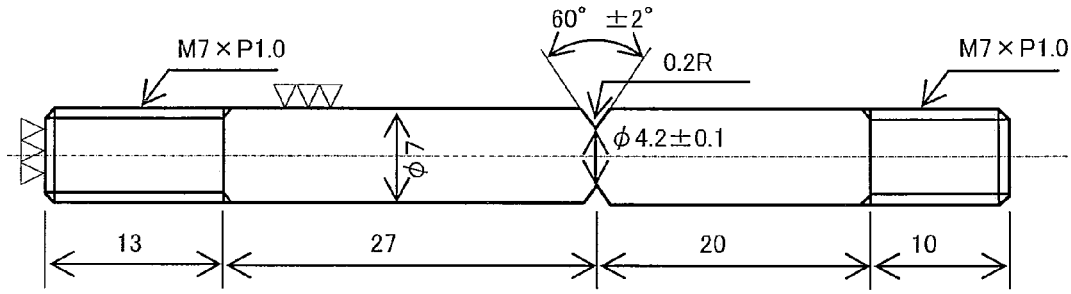
FIG. 2 is an explanatory drawing of a notched specimen for evaluation of hydrogen embrittlement resistance.
Figure 3:
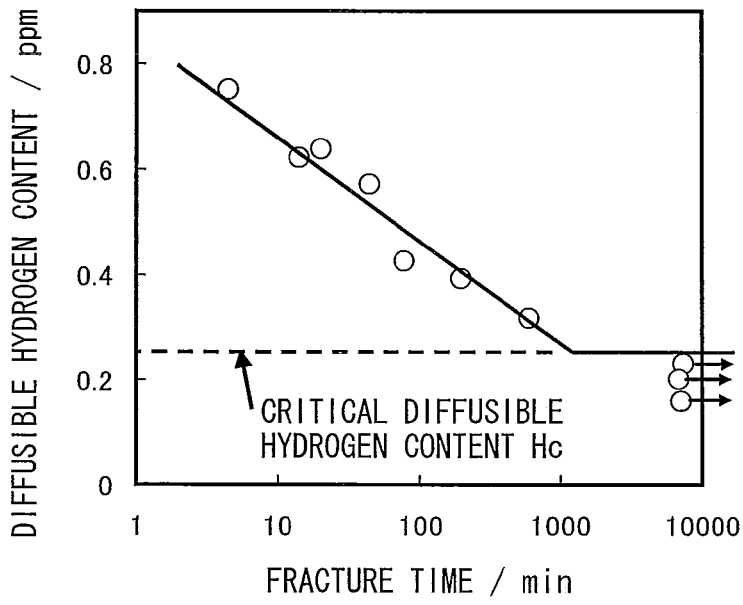
FIG. 3 is a graph showing an example of a relationship between diffusible hydrogen content and fracture time until a delayed fracture occurs.
Figure 4:
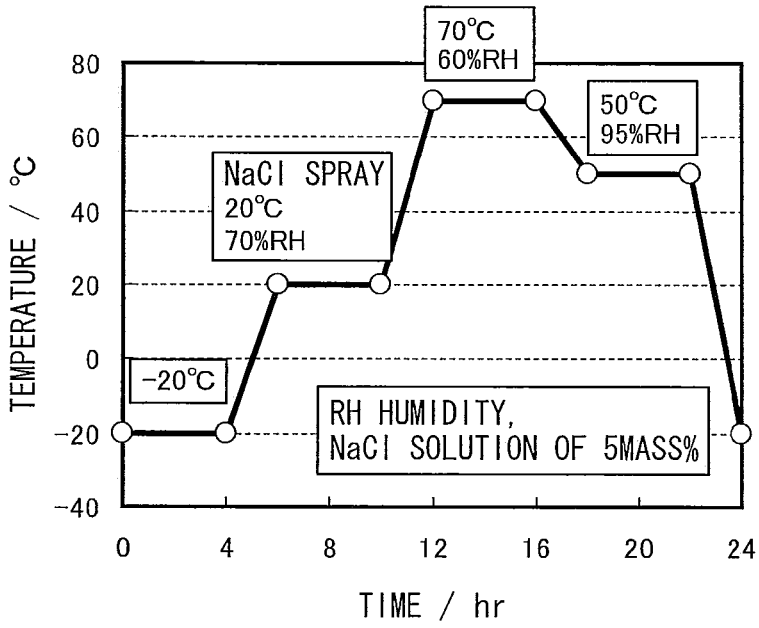
FIG. 4 is a graph showing a repetition condition of drying, wetting, and a temperature change in a corrosion acceleration test.
Figure 5:
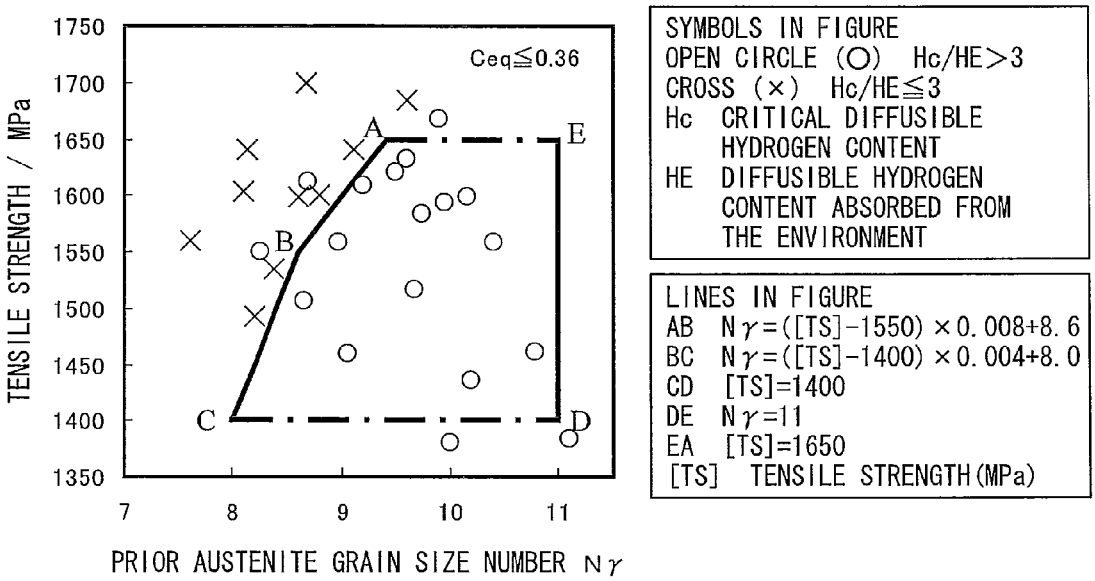
FIG. 5 is a graph showing a relationship among prior austenite grain size number, tensile strength, and delayed fracture resistance.
Figure 6:
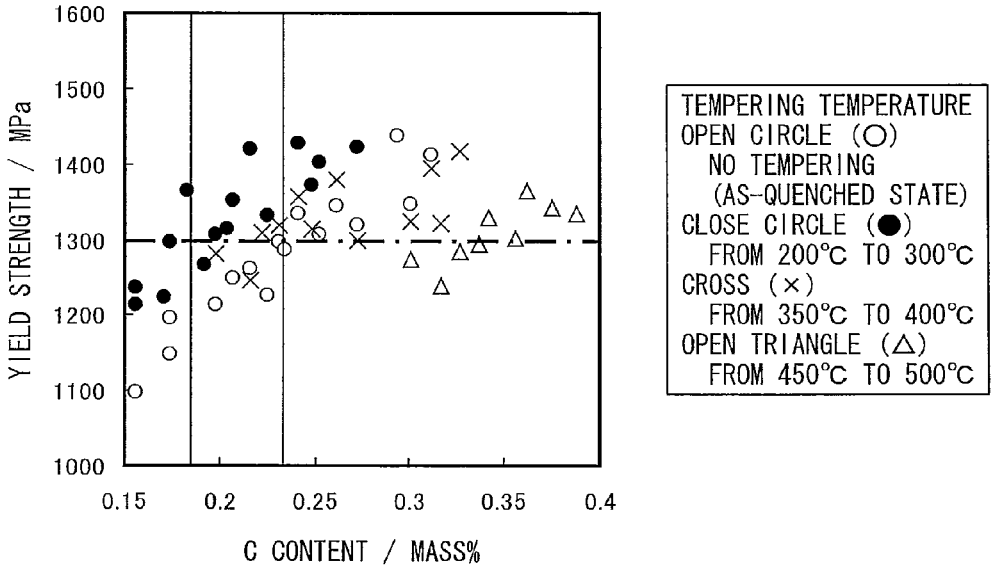
FIG. 6 is a graph showing a relationship among the C content of a martensitic steel, the tempering temperature, and the yield strength.
Figure 7:
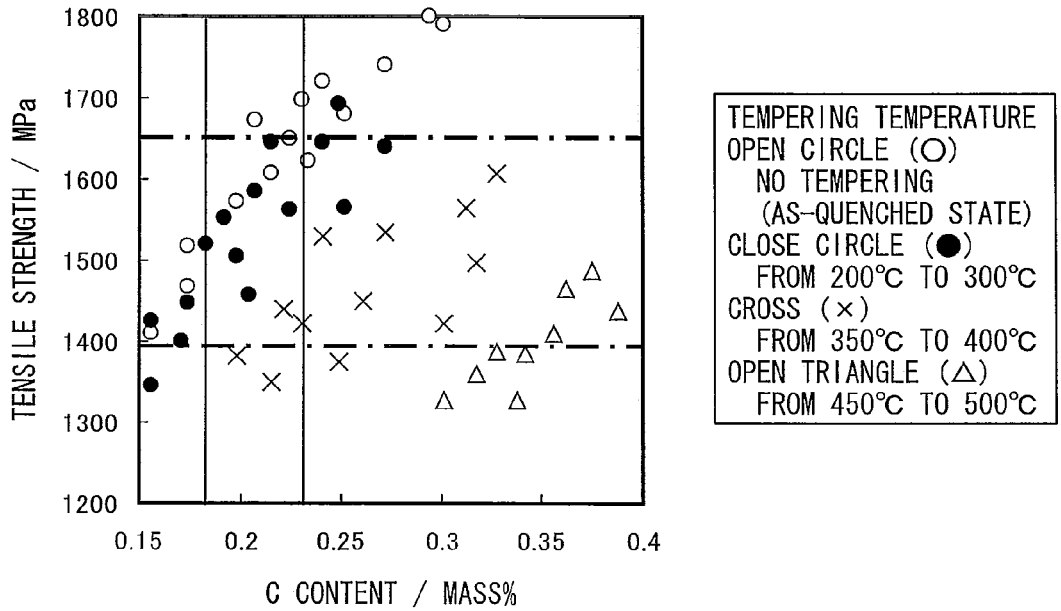
FIG. 7 is a graph showing a relationship among the C content of a martensitic steel, the tempering temperature, and the tensile strength.
Figure 8:
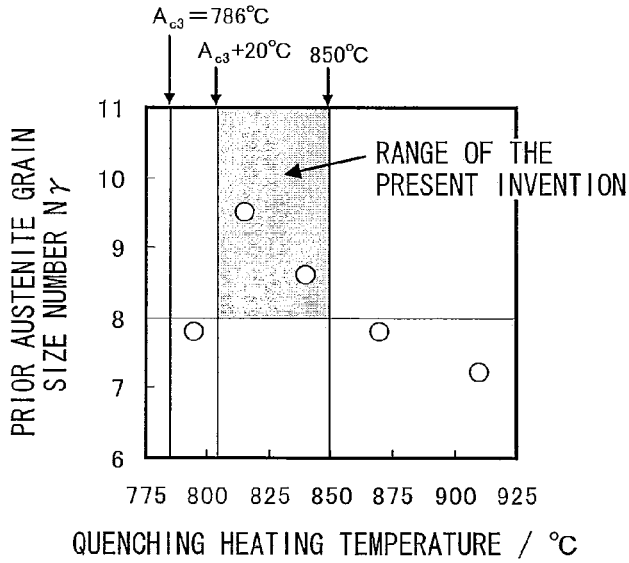
FIG. 8 is a graph showing an example of a relationship between a quenching heating temperature of a martensitic steel and prior austenite grain size number.

According to the present invention, it is possible to economically provide a steel plate which is used as a structural member of a construction machine or an industrial machine, has excellent delayed fracture resistance, bending workability, and weldability, has a yield strength of 1300 MPa or greater, and has a tensile strength of 1400 MPa or greater.

Hereinafter, the present invention will be described in detail.

First, the reason to limit composition in steel of the present invention is described.

C is an important element that has a significant effect on the strength of a martensite structure. According to the present invention, the C content is determined to be the amount needed to obtain a yield strength of 1300 MPa or more and a tensile strength of 1400 MPa or more and 1650 MPa or less when a fraction of martensite is equal to or greater than 90%. A range of the C content is equal to or greater than 0.18% and equal to or less than 0.23%. When the C content is less than 0.18%, a steel plate cannot have a predetermined strength. In addition, when the C content is greater than 0.23%, the strength of the steel plate is excessive, so that workability is degraded. In order to reliably ensure strength, a lower limit of the C content may be set to 0.19% or 0.20%, and an upper limit of the C content may be set to 0.22%.

Si functions as a deoxidizing element and a strengthening element, and the addition of 0.1% or greater of Si exhibits the effects. However, when too much Si is added, an $A_{c3}$ point ($A_{c3}$ transformation point) increases, and there is a concern that the toughness thereof may be degraded. Therefore, an upper limit of the Si content is set to 0.5%. In order to improve the toughness, the upper limit of the Si content may be set to 0.40%, 0.32%, or 0.29%.

Mn is an element effective in improving strength by enhancing hardenability, and is effective in reducing the $A_{c3}$ point. Accordingly, at least 1.0% or greater of Mn is added. However, when the Mn content is greater than 2.0%, segregation is promoted, and this may cause degradation of toughness and weldability. Therefore, the upper limit of Mn to be added is set to 2.0%. In order to stably ensure strength, the lower limit of a Mn content may be set to 1.30%, 1.40%, or 1.50%, and the upper limit of the Mn content may be set to 1.89% or 1.79%.

P is an inevitable impurity and is a harmful element that degrades bending workability. Therefore, the P content is reduced to be equal to or less than 0.020%. In order to enhance the bending workability, the P content may be limited to be equal to or less than 0.010%, 0.008%, or 0.005%.

S is also an inevitable impurity and is a harmful element that degrades delayed fracture resistance and weldability. Therefore, the S content is reduced to be equal to or less than 0.010%. In order to enhance the delayed fracture resistance or weldability, the S content may be limited to be equal to or less than 0.006% or 0.003%.

Ni enhances hardenability and toughness and decreases the $A_{c3}$ point, so that Ni is a very important element according to the present invention. Therefore, at least 0.5% of Ni is added. However, since Ni is expensive, the amount of Ni to be added is set to be equal to or less than 3.0%. In order to further enhance the toughness, a lower limit of the Ni content may be set to 0.8%, 1.0%, or 1.2%. In addition, in order to suppress a cost increase, an upper limit of the Ni content may be set to 2.0%, 1.8%, or 1.5%.

Nb forms fine carbide during rolling and widens a non-recrystallization temperature region, so that Nb enhances effects of controlled rolling and suitable residual strain to a rolled structure before quenching is introduced. In addition, Nb suppresses austenite coarsening during quench-heating due to pinning effects. Accordingly, Nb is a necessary element to obtain a predetermined prior austenite grain size according to the present invention. Therefore, 0.003% or greater of Nb is added. However, when Nb is excessively added, it may cause degradation of weldability. Therefore, the amount of Nb to be added is set to be equal to or less than 0.10%. In order to assure the effect of adding Nb, the lower limit of the Nb content may be set to be 0.008% or 0.012%. In addition, in order to enhance weldability, an upper limit of the Nb content may be set to 0.05%, 0.03%, or 0.02%.

In order to ensure free B needed to enhance hardenability, 0.05% or more of Al is added to fix N. However, excessive addition of Al may degrade toughness, so that the upper limit of Al content is set to 0.15%. There is a concern that the excessive addition of Al degrades the cleanliness of steel, so that the upper limit of the Al content may be set to 0.11% or 0.08%.

B is a necessary element to enhance hardenability. In order to exhibit the effect, the B content needs to be equal to or greater than 0.0003%. However, when B is added at a content level greater than 0.0030%, the weldability or toughness may be degraded. Therefore, the B content is set to be equal to or greater than 0.0003% and equal to or less than 0.0030%. In order to further increase the hardenability enhancement effect due to the addition of B, the lower limit of the B content may be set to 0.0005% or 0.0008%. In addition, in order to prevent the degradation of weldability or toughness, the upper limit of B may be set to 0.0021% or 0.0016%.

When N is excessively contained, toughness may be degraded, and simultaneously, BN is formed, so that the hardenability enhancement effects of B are inhibited. Accordingly, the N content is decreased to be equal to or less than 0.006%.

Steel containing the elements described above and balance composed of Fe and inevitable impurities has a basic composition of the present invention. Moreover, according to the present invention, in addition to the composition, one or more kinds selected from Cu, Cr, Mo, and V may be added.

Cu is an element that can enhance strength without degrading toughness due to solid-solution strengthening Accordingly, 0.05% or more of Cu may be added. However, although a large amount of Cu is added, the strength enhancement effect is limited, and Cu is expensive. Therefore, the amount of Cu to be added is limited to be equal to or less than 0.5%. In order to further reduce cost, the Cu content may be limited to be equal to or less than 0.32% or 0.25%.

Cr enhances hardenability and is effective in enhancing strength. Accordingly, 0.05% or more of Cr may be added. However, when Cr is excessively added, toughness may be degraded. Therefore, the amount of Cr to be added is limited to be equal to or less than 1.5%. In order to prevent the degradation of toughness, the upper limit of the Cr content may be limited to 1.0%, 0.7%, or 0.4%.

Mo enhances hardenability and is effective in enhancing strength. Accordingly, 0.03% or more of Mo may be added. However, under production conditions of the present invention in which a tempering temperature is low, precipitation strengthening effects cannot be expected. Therefore, although a large amount of Mo is added, the strength enhancement effect is limited. In addition, Mo is expensive. Therefore, the amount of Mo to be added is limited to be equal to or less than 0.5%. In order to reduce cost, the upper limit of Mo may be limited to 0.31% or 0.24%.

V also enhances hardenability and is effective in enhancing strength. Accordingly, 0.01% or more of V may be added. However, under production conditions of the present invention in which the tempering temperature is low, precipitation strengthening effects cannot be expected. Therefore, although a large amount of V is added, the strength enhancement effect is limited. In addition, V is expensive. Therefore, the amount of V to be added is limited to be equal to or less than 0.10%. As needed, the V content may be limited to be 0.07% or 0.04%.

In addition to the limitation of the composition ranges, according to the present invention, in order to ensure weldability as described above, a composition is limited so that the weld crack sensitivity index Pcm represented in the following Formula (1) is equal to or less than 0.36%. In order to further enhance weldability, the weld crack sensitivity index Pcm may be set to be equal to or less than 0.35% or 0.34%.

$$Pcm=[C]+[Si]/30+[Mn]/20+[Cu]/20+[Ni]/60+[Cr]/20+[Mo]/15+[V]/10+5[B] \quad (1)$$

where [C], [Si], [Mn], [Cu], [Ni], [Cr], [Mo], [V], and [B] are the concentrations (mass %) of C, Si, Mn, Cu, Ni, Cr, Mo, V, and B, respectively, Moreover, in order to prevent welding embrittlement, a carbon equivalent Ceq represented in the following Formula (2) may be set to be equal to or less than 0.80.

$$Ceq=[C]+[Si]/24+[Mn]/6+[Ni]/40+[Cr]/5+[Mo]/4+[V]/14 \quad (2)$$

Next, a producing method will be described.

First, a slab having the composition in steel described above is heated and subjected to hot rolling. A heating temperature is set to be equal to or greater than 1100° C. so that Nb is sufficiently dissolved in steel.

In addition, the grain size thereof is controlled to be in a range of the prior austenite grain size numbers 8 to 11. Therefore, suitable controlled rolling needs to be performed during the hot rolling, suitable residual strain needs to be introduced into the steel plate before quenching, and a quenching heating temperature needs to be in a range of equal to or greater than 20° C. greater than an $A_{c3}$ transformation point and equal to or less than 850° C.

With regard to the controlled rolling during the hot rolling, rolling is performed so that a cumulative rolling reduction is equal to or greater than 30% and equal to or less than 65% in a temperature range of equal to or less than 930° C. and equal to or greater than 860° C., and the rolling is terminated at a temperature of 860° C. or more, thereby forming a steel plate having a thickness of equal to or greater than 4.5 mm and equal to or less than 25 mm. An object of the controlled rolling is to introduce suitable residual strain into the steel plate before reheat-quenching. In addition, the temperature range of the controlled rolling is a non-recrystallization temperature region of the steel of the present invention suitably containing Nb. The residual strain is not sufficient when the cumulative rolling reduction is less than 30% in this non-recrystallization temperature region. Accordingly, austenite becomes coarse during reheating. When the cumulative rolling reduction is greater than 65% in the non-recrystallization temperature region or the rolling termination temperature is less than 860° C., excessive residual strain is introduced. In this case, the austenite may be given a duplex grain structure during heating. Therefore, even when the quenching heating temperature is in the appropriate range described later, uniform grain-size structure in the range of the prior austenite grain size numbers 8 to 11 cannot be obtained.

After the hot rolling, the steel plate is subjected to quenching including cooling, reheating at a temperature equal to or greater than 20° C. greater than the $A_{c3}$ transformation point and equal to or less than 850° C., and then performing accelerated cooling down to a temperature equal to or less than 200° C. Of course, the quenching heating temperature has to be higher than the $A_{c3}$ transformation point. However, when the heating temperature is set to be immediately above the $A_{c3}$ transformation point, there may be a case where suitable grain size controlling cannot be achieved due to the duplex structure. If the quenching heating temperature is not equal to or greater than 20° C. greater than the $A_{c3}$ transformation point, polygonal grains which have uniform size cannot be reliably obtained. Therefore, in order to allow the quenching heating temperature to be equal to or less than 850° C., the $A_{c3}$ transformation point of the steel needs to be equal to or less than 830° C. The duplex grain structure partially containing coarse grains is not preferable since toughness and delayed fracture resistance are degraded. In addition, particularly, rapid heating is not needed during the quenching heating. Furthermore, several formulae for calculating the $A_{c3}$ transformation point have been proposed. However, precision of the formulae is low in the composition range of this type of steel, so that the $A_{c3}$ transformation point is measured by thermal expansion measurement or the like.

During cooling of the quenching, under a condition in which an average cooling rate at a plate thickness center portion during cooling from 600° C. to 300° C. is equal to or greater than 20° C./s, the steel plate is subjected to accelerated cooling to 200° C. or less. By the cooling, the steel plate having a thickness of equal to or greater than 4.5 mm and equal to or less than 25 mm can be given 90% or more of a martensite structure in structural fraction. The cooling rate at the plate thickness center portion cannot be directly measured, and so is calculated by heat transfer calculation from the thickness, surface temperature, and cooling conditions.

The martensite structure in the as-quenched state has a low yield ratio. Accordingly, in order to increase the yield strength, tempering is performed in a temperature range of equal to or greater than 200° C. and equal to or less than 300° C. At a tempering temperature of less than 200° C., an effect in increasing the yield strength cannot be obtained. On the other hand, when the tempering temperature is greater than 300° C., tempering embrittlement occurs, so that toughness is degraded. Accordingly, the tempering is performed in the temperature range of equal to or greater than 200° C. and equal to or less than 300° C. A tempering time may be 15 minutes or longer.

Steels A to AE having compositions shown in Tables 1 and 2 are smelted to obtain slabs. Using the slabs, steel plates having thickness of 4.5 to 25 mm were produced according to production conditions of Example 1 to 15 of the present invention shown in Table 3 and Comparative Examples 16 to 46 shown in Table 5.

For the steel plates, yield strength, tensile strength, prior austenite grain size number, fraction of martensite structure, welding crack sensitivity, bending workability, delayed fracture resistance, and toughness were evaluated. Table 4 shows results of Examples 1 to 15 of the present invention, and Table 6 shows results of Comparative Examples 16 to 46. In addition, the $A_{c3}$ transformation points were measured.

TABLE 1

(mass %)

| | Composition of Steel | C | Si | Mn | P | S | Cu | Ni | Cr | Mo | Al | Nb | V | B | N | Ceq | Pcm | $A_{c3}$ (° C.) |
|---|---|---|---|---|---|---|---|---|---|---|---|---|---|---|---|---|---|---|
| Example | A | 0.212 | 0.22 | 1.68 | 0.002 | 0.002 | | 1.32 | | | 0.08 | 0.015 | | 0.0011 | 0.0032 | 0.534 | 0.331 | 791 |
| | B | 0.197 | 0.37 | 1.87 | 0.004 | 0.001 | | 0.84 | | | 0.07 | 0.008 | | 0.0010 | 0.0041 | 0.545 | 0.322 | 806 |
| | C | 0.221 | 0.24 | 1.66 | 0.005 | 0.001 | | 1.02 | | | 0.08 | 0.012 | | 0.0013 | 0.0027 | 0.533 | 0.336 | 796 |
| | D | 0.198 | 0.15 | 1.79 | 0.003 | 0.003 | | 2.72 | | | 0.09 | 0.018 | | 0.0012 | 0.0036 | 0.571 | 0.344 | 768 |
| | E | 0.197 | 0.18 | 1.41 | 0.004 | 0.001 | | 1.11 | 0.64 | | 0.06 | 0.015 | | 0.0012 | 0.0032 | 0.595 | 0.330 | 797 |
| | F | 0.212 | 0.14 | 1.39 | 0.005 | 0.001 | | 1.63 | | 0.31 | 0.07 | 0.031 | | 0.0013 | 0.0033 | 0.568 | 0.341 | 786 |
| | G | 0.217 | 0.35 | 1.37 | 0.003 | 0.002 | | 0.95 | 0.37 | 0.12 | 0.08 | 0.012 | | 0.0012 | 0.0040 | 0.588 | 0.346 | 807 |
| | H | 0.211 | 0.22 | 1.89 | 0.003 | 0.002 | | 0.81 | | | 0.09 | 0.009 | 0.061 | 0.0016 | 0.0028 | 0.560 | 0.340 | 799 |
| | I | 0.207 | 0.23 | 1.54 | 0.003 | 0.002 | 0.32 | 1.24 | | | 0.08 | 0.013 | | 0.0011 | 0.0032 | 0.504 | 0.334 | 796 |
| | J | 0.213 | 0.29 | 1.68 | 0.005 | 0.001 | | 1.02 | | 0.24 | 0.09 | 0.013 | 0.032 | 0.0008 | 0.0029 | 0.593 | 0.347 | 804 |
| | K | 0.195 | 0.32 | 1.52 | 0.004 | 0.002 | 0.25 | 1.05 | 0.37 | 0.11 | 0.11 | 0.014 | | 0.0021 | 0.0050 | 0.589 | 0.348 | 803 |

TABLE 2

(mass %)

| | Composition of Steel | C | Si | Mn | P | S | Cu | Ni | Cr | Mo | Al | Nb | V | B | N | Ceq | Pcm | $A_{c3}$ (° C.) |
|---|---|---|---|---|---|---|---|---|---|---|---|---|---|---|---|---|---|---|
| Comparative Example | L | 0.162 | 0.38 | 1.92 | 0.004 | 0.002 | | 1.41 | | | 0.05 | 0.015 | | 0.0012 | 0.0042 | 0.533 | 0.300 | 807 |
| | M | 0.251 | 0.24 | 1.37 | 0.005 | 0.002 | | 1.02 | | | 0.07 | 0.009 | | 0.0014 | 0.0039 | 0.515 | 0.352 | 795 |
| | N | 0.195 | 0.01 | 1.95 | 0.004 | 0.001 | | 1.15 | | | 0.08 | 0.016 | | 0.0009 | 0.0041 | 0.549 | 0.317 | 792 |

TABLE 2-continued

| Composition of Steel | C | Si | Mn | P | S | Cu | Ni | Cr | Mo | Al | Nb | V | B | N | Ceq | Pcm | (mass %) $A_{c3}$ (° C.) |
|---|---|---|---|---|---|---|---|---|---|---|---|---|---|---|---|---|---|
| O | 0.201 | 0.81 | 1.84 | 0.007 | 0.002 | | 0.87 | | | 0.06 | 0.015 | | 0.0008 | 0.0028 | 0.563 | 0.339 | 846 |
| P | 0.225 | 0.45 | 0.68 | 0.002 | 0.002 | | 1.25 | | | 0.06 | 0.021 | | 0.0011 | 0.0036 | 0.388 | 0.300 | 812 |
| Q | 0.197 | 0.25 | 2.54 | 0.003 | 0.003 | | 1.01 | | | 0.06 | 0.015 | | 0.0012 | 0.0041 | 0.656 | 0.355 | 795 |
| R | 0.197 | 0.28 | 1.78 | 0.033 | 0.001 | | 1.05 | | | 0.08 | 0.014 | | 0.0012 | 0.0035 | 0.532 | 0.319 | 801 |
| S | 0.203 | 0.29 | 1.65 | 0.004 | 0.014 | | 1.32 | | | 0.07 | 0.015 | | 0.0012 | 0.0029 | 0.523 | 0.323 | 800 |
| T | 0.204 | 0.28 | 1.44 | 0.005 | 0.001 | | 0.24 | | | 0.07 | 0.015 | | 0.0013 | 0.0034 | 0.462 | 0.296 | 847 |
| U | 0.198 | 0.25 | 1.15 | 0.005 | 0.001 | | 0.99 | 1.65 | | 0.06 | 0.013 | | 0.0014 | 0.0037 | 0.755 | 0.370 | 804 |
| V | 0.196 | 0.27 | 1.34 | 0.005 | 0.002 | | 1.05 | | 0.95 | 0.08 | 0.019 | | 0.0012 | 0.0038 | 0.694 | 0.359 | 816 |
| W | 0.210 | 0.20 | 1.52 | 0.005 | 0.002 | | 1.02 | | | 0.21 | 0.018 | | 0.0012 | 0.0038 | 0.497 | 0.316 | 802 |
| X | 0.218 | 0.24 | 1.78 | 0.005 | 0.001 | | 1.09 | | | 0.09 | 0.001 | | 0.0014 | 0.0038 | 0.552 | 0.340 | 802 |
| Y | 0.215 | 0.32 | 1.38 | 0.004 | 0.003 | | 0.87 | | | 0.07 | 0.125 | | 0.0014 | 0.0041 | 0.480 | 0.316 | 815 |
| Z | 0.208 | 0.32 | 1.64 | 0.005 | 0.001 | | 1.15 | | | 0.06 | 0.015 | 0.190 | 0.0016 | 0.0032 | 0.537 | 0.347 | 811 |
| AA | 0.209 | 0.26 | 1.49 | 0.004 | 0.001 | | 1.31 | | | 0.07 | 0.016 | | 0.0001 | 0.0033 | 0.501 | 0.315 | 802 |
| AB | 0.204 | 0.23 | 1.59 | 0.004 | 0.002 | | 1.05 | | | 0.07 | 0.016 | | 0.0054 | 0.0033 | 0.505 | 0.336 | 801 |
| AC | 0.214 | 0.21 | 1.50 | 0.003 | 0.002 | | 0.97 | | | 0.09 | 0.012 | | 0.0009 | 0.0097 | 0.497 | 0.317 | 805 |
| AD | 0.222 | 0.35 | 1.91 | 0.004 | 0.001 | | 1.27 | 0.39 | | 0.06 | 0.012 | | 0.0015 | 0.0031 | 0.665 | 0.377 | 798 |
| AE | 0.192 | 0.44 | 1.15 | 0.002 | 0.003 | | 0.79 | 0.32 | | 0.07 | 0.009 | | 0.0013 | 0.0032 | 0.486 | 0.300 | 846 |

TABLE 3

| | Steel Sheet | Composition of Steel | Thick-ness (mm) | Heating Temperature (° C.) | Cumulative Rolling Reduction (%) in Range of 930° C. to 860° C. | Rolling Termination Temperature (° C.) | Quenching Heating Temperature (° C.) | Cooling Rate (Calculated Value) from 600° C. to 300° C. (° C./sec) | Accelerated Cooling Termination Temperature (° C.) | Tempering Temperature (° C.) |
|---|---|---|---|---|---|---|---|---|---|---|
| Example | 1 | A | 25 | 1150 | 35 | 862 | 845 | 26 | <200 | 200 |
| | 2 | A | 4.5 | 1200 | 50 | 866 | 840 | 125 | <200 | 250 |
| | 3 | B | 25 | 1150 | 40 | 870 | 850 | 29 | <200 | 250 |
| | 4 | B | 12 | 1200 | 50 | 865 | 845 | 95 | <200 | 300 |
| | 5 | C | 25 | 1150 | 50 | 867 | 835 | 25 | <200 | 250 |
| | 6 | D | 25 | 1150 | 40 | 876 | 820 | 27 | <200 | 225 |
| | 7 | E | 25 | 1150 | 45 | 862 | 840 | 22 | <200 | 250 |
| | 8 | F | 25 | 1150 | 50 | 867 | 816 | 24 | <200 | 250 |
| | 9 | F | 9 | 1200 | 60 | 880 | 830 | 105 | <200 | 300 |
| | 10 | G | 25 | 1150 | 45 | 862 | 850 | 27 | <200 | 250 |
| | 11 | H | 16 | 1150 | 55 | 866 | 850 | 72 | <200 | 250 |
| | 12 | H | 25 | 1150 | 45 | 869 | 850 | 22 | <200 | 250 |
| | 13 | I | 25 | 1150 | 55 | 878 | 830 | 25 | <200 | 250 |
| | 14 | J | 25 | 1150 | 35 | 871 | 840 | 27 | <200 | 250 |
| | 15 | K | 25 | 1150 | 40 | 863 | 840 | 30 | <200 | 225 |

TABLE 4

| | Steel Sheet | Prior Austenite Grain Size Number | Fraction of Martensite Structure (%) | Yield Strength (MPa) | Tensile Strength (MPa) | y-groove Weld Cracking Test Result | Bending Workability Test Result | Delayed Fracture Resistance Test Result | Absorbed Energy (J) at −20° C. |
|---|---|---|---|---|---|---|---|---|---|
| Example | 1 | 9.6 | >90 | 1372 | 1532 | Acceptable | Acceptable | Acceptable | 59 |
| | 2 | 10.3 | >90 | 1409 | 1612 | — | Acceptable | Acceptable | 63* |
| | 3 | 9.4 | >90 | 1331 | 1495 | Acceptable | Acceptable | Acceptable | 51 |
| | 4 | 9.8 | >90 | 1396 | 1591 | — | Acceptable | Acceptable | 48 |
| | 5 | 9.9 | >90 | 1357 | 1550 | Acceptable | Acceptable | Acceptable | 52 |
| | 6 | 10.6 | >90 | 1378 | 1561 | Acceptable | Acceptable | Acceptable | 68 |
| | 7 | 9.6 | >90 | 1366 | 1547 | Acceptable | Acceptable | Acceptable | 62 |
| | 8 | 10.6 | >90 | 1381 | 1541 | Acceptable | Acceptable | Acceptable | 53 |
| | 9 | 10.3 | >90 | 1398 | 1587 | — | Acceptable | Acceptable | 54* |
| | 10 | 10.1 | >90 | 1427 | 1605 | Acceptable | Acceptable | Acceptable | 60 |
| | 11 | 9.9 | >90 | 1369 | 1572 | — | Acceptable | Acceptable | 64 |
| | 12 | 9.6 | >90 | 1342 | 1530 | Acceptable | Acceptable | Acceptable | 65 |
| | 13 | 10.5 | >90 | 1360 | 1523 | Acceptable | Acceptable | Acceptable | 51 |
| | 14 | 9.7 | >90 | 1415 | 1595 | Acceptable | Acceptable | Acceptable | 61 |
| | 15 | 10.3 | >90 | 1398 | 1612 | Acceptable | Acceptable | Acceptable | 67 |

*Subsize Charpy Specimen(Absorbed Energy Is Converted on the Basis of Specimen of Type 4)

TABLE 5

| | Steel Sheet | Composition of Steel | Thick-ness (mm) | Heating Tempera-ture (° C.) | Cumulative Rolling Reduction (%) in Range of 930° C. to 860° C. | Rolling Termination Temperature (° C.) | Quenching Heating Temperature (° C.) | Cooling Rate (Calculated Value) from 600° C. to 300° C. (° C./sec) | Accelerated Cooling Termination Temperature (° C.) | Tempering Temperature (° C.) |
|---|---|---|---|---|---|---|---|---|---|---|
| Comparative Example | 16 | L | 25 | 1150 | 50 | 862 | 850 | 27 | <200 | 250 |
| | 17 | M | 25 | 1150 | 50 | 866 | 830 | 24 | <200 | 250 |
| | 18 | N | 25 | 1150 | 55 | 867 | 830 | 26 | <200 | 225 |
| | 19 | O | 25 | 1150 | 45 | 869 | 870 | 28 | <200 | 225 |
| | 20 | P | 25 | 1150 | 40 | 863 | 845 | 24 | <200 | 250 |
| | 21 | Q | 25 | 1150 | 45 | 870 | 830 | 23 | <200 | 250 |
| | 22 | R | 25 | 1150 | 50 | 879 | 840 | 26 | <200 | 250 |
| | 23 | S | 25 | 1150 | 50 | 862 | 835 | 26 | <200 | 250 |
| | 24 | T | 25 | 1150 | 55 | 869 | 870 | 29 | <200 | 250 |
| | 25 | U | 25 | 1150 | 55 | 869 | 840 | 28 | <200 | 250 |
| | 26 | V | 25 | 1150 | 50 | 871 | 850 | 27 | <200 | 250 |
| | 27 | W | 25 | 1150 | 50 | 873 | 840 | 29 | <200 | 250 |
| | 28 | X | 25 | 1150 | 55 | 875 | 840 | 26 | <200 | 250 |
| | 29 | Y | 25 | 1150 | 40 | 867 | 850 | 29 | <200 | 225 |
| | 30 | Z | 25 | 1150 | 45 | 866 | 845 | 25 | <200 | 250 |
| | 31 | AA | 25 | 1150 | 50 | 864 | 840 | 24 | <200 | 225 |
| | 32 | AB | 25 | 1150 | 50 | 872 | 850 | 28 | <200 | 275 |
| | 33 | AC | 25 | 1150 | 50 | 879 | 850 | 27 | <200 | 250 |
| | 34 | AD | 25 | 1150 | 45 | 865 | 840 | 25 | <200 | 250 |
| | 35 | AE | 25 | 1150 | 50 | 867 | 870 | 29 | <200 | 250 |
| | 36 | A | 25 | 1000 | 50 | 870 | 840 | 26 | <200 | 250 |
| | 37 | C | 25 | 1150 | 20 | 862 | 840 | 27 | <200 | 250 |
| | 38 | D | 25 | 1150 | 55 | 875 | 790 | 26 | <200 | 250 |
| | 39 | A | 25 | 1150 | 50 | 865 | 880 | 29 | <200 | 250 |
| | 40 | A | 25 | 1150 | 50 | 867 | 840 | 14 | <200 | 250 |
| | 41 | C | 25 | 1150 | 50 | 867 | 840 | 27 | <200 | No |
| | 42 | C | 25 | 1150 | 45 | 869 | 840 | 28 | <200 | 350 |
| | 43 | C | 25 | 1150 | 45 | 871 | 840 | 28 | <200 | 450 |
| | 44 | C | 25 | 1150 | 75 | 873 | 840 | 26 | <200 | 250 |
| | 45 | A | 25 | 1150 | 50 | 820 | 850 | 29 | <200 | 250 |
| | 46 | A | 25 | 1150 | 50 | 867 | 850 | 29 | 300 | 250 |

TABLE 6

| | Steel Sheet | Prior Austenite Grain Size Number | Fraction of Martensite Structure (%) | Yield Strength (MPa) | Tensile Strength (MPa) | y-groove Weld Cracking Test Result | Bending Workability Test Result | Delayed Fracture Resistance Test Result | Absorbed Energy (J) at −20° C. |
|---|---|---|---|---|---|---|---|---|---|
| Comparative Example | 16 | 9.8 | >90 | 1257 | 1437 | Acceptable | Acceptable | Acceptable | 62 |
| | 17 | 10.6 | >90 | 1435 | 1695 | Unacceptable | Unacceptable | Unacceptable | 35 |
| | 18 | 9.9 | >90 | 1345 | 1511 | Acceptable | Acceptable | Acceptable | 18 |
| | 19 | 8.0 | >90 | 1387 | 1551 | Acceptable | Acceptable | Unacceptable | 36 |
| | 20 | 9.9 | >90 | 1256 | 1445 | Acceptable | Acceptable | Acceptable | 57 |
| | 21 | 10.2 | >90 | 1448 | 1637 | Unacceptable | Acceptable | Acceptable | 19 |
| | 22 | 9.6 | >90 | 1378 | 1524 | Unacceptable | Acceptable | Acceptable | 40 |
| | 23 | 10.3 | >90 | 1366 | 1511 | Acceptable | Acceptable | Unacceptable | 29 |
| | 24 | 8.1 | >90 | 1360 | 1572 | Acceptable | Unacceptable | Unacceptable | 37 |
| | 25 | 9.4 | >90 | 1421 | 1612 | Unacceptable | Acceptable | Acceptable | 32 |
| | 26 | 9.5 | >90 | 1430 | 1605 | Acceptable | Acceptable | Acceptable | 19 |
| | 27 | 9.9 | >90 | 1335 | 1510 | Acceptable | Acceptable | Acceptable | 22 |
| | 28 | 7.8 | >90 | 1401 | 1602 | Acceptable | Unacceptable | Unacceptable | 34 |
| | 29 | 9.1 | >90 | 1405 | 1597 | Unacceptable | Acceptable | Acceptable | 30 |
| | 30 | 9.3 | >90 | 1389 | 1605 | Acceptable | Acceptable | Acceptable | 17 |
| | 31 | 9.6 | >90 | 1278 | 1465 | Acceptable | Acceptable | Acceptable | 51 |
| | 32 | 9.2 | >90 | 1387 | 1578 | Acceptable | Acceptable | Acceptable | 21 |
| | 33 | 9.0 | >90 | 1265 | 1431 | Acceptable | Acceptable | Acceptable | 19 |
| | 34 | 9.5 | >90 | 1352 | 1542 | Unacceptable | Acceptable | Acceptable | 35 |
| | 35 | 8.1 | >90 | 1397 | 1569 | Acceptable | Acceptable | Unacceptable | 48 |
| | 36 | 7.8 | >90 | 1302 | 1587 | Acceptable | Unacceptable | Unacceptable | 35 |
| | 37 | 8.2 | >90 | 1379 | 1599 | Acceptable | Acceptable | Unacceptable | 44 |
| | 38 | 11.9 | 80 | 1261 | 1439 | Acceptable | Acceptable | Acceptable | 69 |
| | 39 | 8.1 | >90 | 1357 | 1547 | Acceptable | Acceptable | Unacceptable | 40 |
| | 40 | 9.1 | 70 | 1238 | 1425 | Acceptable | Acceptable | Acceptable | 86 |
| | 41 | 9.6 | >90 | 1262 | 1602 | Acceptable | Acceptable | Acceptable | 65 |
| | 42 | 9.9 | >90 | 1315 | 1416 | Acceptable | Acceptable | Acceptable | 21 |
| | 43 | 9.9 | >90 | 1187 | 1232 | Acceptable | Acceptable | Acceptable | 61 |
| | 44 | 8.6 | >90 | 1337 | 1589 | Acceptable | Acceptable | Unacceptable | 40 |

TABLE 6-continued

| Steel Sheet | Prior Austenite Grain Size Number | Fraction of Martensite Structure (%) | Yield Strength (MPa) | Tensile Strength (MPa) | y-groove Weld Cracking Test Result | Bending Workability Test Result | Delayed Fracture Resistance Test Result | Absorbed Energy (J) at −20° C. |
|---|---|---|---|---|---|---|---|---|
| 45 | 8.6 | >90 | 1337 | 1542 | Acceptable | Acceptable | Unacceptable | 42 |
| 46 | 9.8 | 50 | 1306 | 1389 | Acceptable | Acceptable | Acceptable | 54 |

* Subsize Charpy Specimen(Absorbed Energy Is Converted on the Basis of Specimen of Type 4)

The yield strength and the tensile strength were measured by acquiring 1A-type specimens for a tensile test specified in JIS Z 2201 according to a tensile test specified in JIS Z 2241. Yield strengths equal to or greater than 1300 MPa are determined to be "Acceptable" and tensile strengths in the range of 1400 to 1650 MPa is determined to be "Acceptable".

The prior austenite grain size number was measured by JIS G 0551 (2005), and the tensile strength and the prior austenite grain size number were determined to be "Acceptable" when they were determined to satisfy the (a) and (b) described above.

In order to evaluate a fraction of martensite structure, a specimen acquired from the vicinity of a plate thickness center portion is used, and 5 fields of a range of 20 μm×30 μm were observed at a magnification of 5000× by a transmission electron microscope. An area of a martensite structure in each field was measured, and a fraction of martensite structure was calculated from an average value of the areas. Here, the martensite structure has a high dislocation density, and only a small amount of cementite was generated during tempering at a temperature of 300° C. or less. Accordingly, the martensite structure can be distinguished from a bainite structure and the like.

In order to evaluate weld crack sensitivity, a y-groove weld cracking test specified in JIS Z 3158 was performed. The thicknesses of the steel plates provided for the evaluation were all 25 mm except for those of Examples 2, 4, 9, and 11, and $CO_2$ welding at a heat input of 15 kJ/cm was performed. As a result of the test, when a root crack ratio is 0 of a specimen at a preheating temperature of 150° C., it is determined to be "Acceptable". In addition, since it was thought that weldability of the steel plates of Examples 2, 4, 9, and 11 which have thicknesses less than 25 mm is the same as that of Examples 1, 3, 8, and 12 having the same compositions, the y-groove weld cracking test was omitted.

In order to evaluate bending workability, 180° bending was performed using JIS 1-type specimens (a longitudinal direction of the specimen is a direction perpendicular to a rolling direction of the steel plate) by a method specified in JIS Z 2248 so that a bending radius (3t) becomes three times the thickness of the steel plate. After the bending test, a case where cracks and other defects do not occur on the outside of a bent portion was referred to as "Acceptable".

In order to evaluate the delayed fracture resistance, "critical diffusible hydrogen content Hc" and "diffusible hydrogen content absorbed from the environment HE" of each steel plate were measured. When Hc/HE is greater than 3, the delayed fracture resistance was evaluated as "Acceptable".

In order to evaluate toughness, 4-type Charpy specimens specified in JIS Z 2201 were sampled at a right angle with respect to the rolling direction from the plate thickness center portion, and a Charpy impact test was performed on the three specimens at −20° C. An average value of absorbed energies of the specimens was calculated and a target of the average value is equal to or greater than 27 J. In addition, a 5 mm subsize Charpy specimen was used for the steel plate (Example 9) having a thickness of 9 mm, and a 3 mm subsize Charpy specimen was used for the steel plate (Example 2) having a thickness of 4.5 mm. When the subsize Charpy specimen is assumed to have a width of 4-type Charpy specimen (that is, when the width is 10 mm), an absorbed energy value of 27 J or greater was set to a target value.

In addition, the $A_{c3}$ transformation point was measured by thermal expansion measurement under a condition at a temperature increase rate of 2.5° C./min using a Formastor-FII of Fuji Electronic Industrial Co., Ltd.

Chemical compositions, Pcm values, and $A_{c3}$ points underlined in Tables 1 and 2 do not satisfy the condition of the present invention. Values underlined in Tables 3 to 6 represent values that do not satisfy the production conditions of the present invention or have insufficient properties.

In Examples 1 to 15 of the present invention shown in Tables 3 and 4, the yield strength, tensile strength, prior austenite grain size number, fraction of martensite structure, welding crack sensitivity, bending workability, delayed fracture resistance, and toughness all satisfy the target values. However, chemical compositions of Comparative Examples 16 to 33 underlined in Tables 5 and 6 do not satisfy the range limited by the present invention. Accordingly, even though Comparative Examples 16 to 33 are in the ranges of the production conditions of the present invention, one or more of the yield strength, tensile strength, prior austenite grain size number, fraction of martensite structure, welding crack sensitivity, bending workability, delayed fracture resistance, and toughness do not satisfy the target values. Although the steel composition in Comparative Example 34 is in the range of the present invention, since the weld crack sensitivity index Pcm do not satisfy the range of the present invention, the weld crack sensitivity is determined to be "Unacceptable". Although the steel composition in Comparative Example 35 is in the range of the present invention, since the $A_{c3}$ point does not satisfy the range of the present invention, a low quenching heating temperature cannot be achieved. Accordingly, grain refining of prior austenite is not sufficiently achieved, so that the delayed fracture resistance is determined to be "Unacceptable". In Comparative Examples 36 to 46, the steel composition, the weld crack sensitivity index Pcm, the $A_{c3}$ point are in the ranges of the present invention, the production conditions of the present invention is not satisfied. Accordingly, one or more of the yield strength, tensile strength, prior austenite grain size number, fraction of martensite structure, welding crack sensitivity, bending workability, delayed fracture resistance, and toughness do not satisfy the target values. That is, in Comparative Example 36, a heating temperature is low, and Nb is not dissolved in steel, so that grain refining of austenite is insufficient. Therefore, the bending workability and delayed fracture resistance of Comparative Example 36 are determined to be "Unacceptable". In Comparative Example 37, as the cumulative rolling reduction is low in the temperature range of equal to or less than 930° C. and equal to or greater than 860° C., grain refining of austenite is insufficient. Therefore, the delayed fracture resistance of Comparative Example 37 is determined to be "Unacceptable". In Comparative Example 38, since a quenching heating temperature is less than 800° C., the austenite grain size is refined too much. Therefore, the hardenability is degraded, so that a fraction of martensite structure of 90% or greater cannot be obtained. Consequently, since the yield strength is low, Comparative Example 38 is determined to be "Unacceptable". In Comparative Example 39, since the quenching heating temperature is greater than 850° C., grain refining of austenite is insufficient. Therefore, the delayed fracture resistance is determined to be "Unacceptable". In Comparative Example 40, as a cooling rate during cooling from 600° C. to 300° C. is low, a fraction of martensite structure of 90% or greater cannot be obtained. Therefore, the yield strength of Comparative Example 39 is low and is determined to be "Unacceptable". In Comparative Example 41, tempering is not performed, so that the yield strength is low and is determined to be "Unacceptable". In Comparative Example 42, the tempering temperature exceeds 300° C., so that the toughness is low and is determined to be "Unacceptable". In Comparative Example 43, the tempering temperature is higher than that of Comparative Example 42, so that the strength is low and is determined to be "Unacceptable". In Comparative Example 44, the cumulative rolling reduction is high in the temperature range of equal to or less than 930° C. and equal to or greater than 860° C., so that grain refining of austenite is insufficient. Therefore, the delayed fracture resistance of Comparative Example 44 is determined to be "Unacceptable". In Comparative Example 45, the rolling termination temperature is low, so that grain refining of austenite is insufficient. Therefore, the delayed fracture resistance of Comparative Example 45 is determined to be "Unacceptable". In Comparative Example 46, the accelerated cooling termination temperature is high, so that hardenability is insufficient, and a fraction of martensite structure of 90% or greater cannot be obtained. Therefore, the tensile strength of Comparative Example 46 is low and is determined to be "Unacceptable". In addition, in Comparative Example 46, after the steel plate was subjected to accelerated cooling down to 300° C., the steel plate was subjected to air cooling to 200° C. and then tempered to 250° C.

It is possible to provide a high-strength steel plate which has excellent delayed fracture resistance, bending workability, and weldability and a producing method therefor.

While preferred embodiments of the invention have been described and illustrated above, it should be understood that these are exemplary of the invention and are not to be considered as limiting. Additions, omissions, substitutions, and other modifications can be made without departing from the scope of the present invention. Accordingly, the invention is not to be considered as being limited by the foregoing description, and is only limited by the scope of the appended claims.

What is claimed is:

1. A high-strength steel plate consisting of the following composition:

by mass %,
0.18 to 0.23% of C;
0.1 to 0.5% of Si;
1.0 to 2.0% of Mn;
0.020% or less of P;
0.010% or less of S;
0.5 to 3.0% of Ni;
0.003 to 0.10% of Nb;
0.05 to 0.15% of Al;
0.0003 to 0.0030% of B;
0.006% or less of N; and optionally further containing one or more kinds selected from the group consisting of:
by mass %,
0.05 to 0.5% of Cu;
0.05 to 1.5% of Cr;
0.03 to 0.5% of Mo; and
0.01 to 0.10% of V; and a balance composed of Fe and inevitable impurities, wherein a weld crack sensitivity index Pcm is calculated by Pcm=[C]+[Si]/30+[Mn]/20+[Cu]/20+[Ni]/60+[Cr]/20+[Mo]/15+[V]/10+5[B], and is 0.36% or less, wherein [C], [Si], [Mn], [Cu], [Ni], [Cr], [Mo], [V], and [B] are the concentrations (mass %) of C, Si, Mn, Cu, Ni, Cr, Mo, V, and B, respectively, an $A_{c3}$ transformation point is equal to or less than 830° C., a percentage value of a martensite structure is equal to or greater than 90%, prior austenite grains are polygonal grains which have uniform size, a yield strength is equal to or greater than 1300 MPa, a tensile strength is equal to or greater than 1400 MPa and equal to or less than 1650 MPa, a prior austenite grain size number Nγ of the prior austenite grains is calculated by $N\gamma=-3+\log_2 m$ using an average number m of crystal grains per 1 $mm^2$ in a cross section of a sample piece, the prior austenite grain size number Nγ of the high-strength steel plate is in a range of 8.0 to 11.0, if the tensile strength is less than 1550 MPa, the prior austenite grain size number Nγ and the tensile strength satisfy the formulae $N\gamma \geqq ([TS]-1400)\times 0.004+8.0$ and $N\gamma \leqq 11.0$, and if the tensile strength is equal to or greater than 1550 MPa, the prior austenite grain size number Nγ and the tensile strength satisfy the formulae $N\gamma \geqq ([TS]-1550)\times 0.008+8.6$ and Nγ11.0, where [TS] (MPa) is the tensile strength, and an average value of an absorbed energy of the high-strength steel plate at −20° C. is equal to or greater than 27 J per 10 mm regarding a width of a Charpy specimen.

2. The high-strength steel plate according to claim 1, further containing one or more kinds selected from the group consisting of:

by mass %,
0.05 to 0.5% of Cu;
0.05 to 1.5% of Cr;
0.03 to 0.5% of Mo; and
0.01 to 0.10% of V.

3. The high-strength steel plate according to claim 1 or 2, wherein a thickness is equal to or greater than 4.5 mm and equal to or less than 25 mm.

4. A producing method for a high-strength steel plate, the method comprising:

heating a slab having the composition according to claims 1 or 2, to 1100° C. or greater;

performing hot rolling in which a cumulative rolling reduction is equal to or greater than 30% and equal to or less than 65% in a temperature range of equal to or less than 930° C. and equal to or greater than 860° C. and the rolling is terminated at a temperature of equal to or greater than 860° C., thereby producing a steel plate having a thickness of equal to or greater than 4.5 mm and equal to or less than 25 mm;

reheating the steel plate at a temperature of equal to or greater than 20° C. greater than a $A_{c3}$ transformation point and equal to or less than 850° C. after cooling;

performing accelerated cooling to 200° C. or less under a cooling condition in which an average cooling rate at a plate thickness center portion of the steel plate from 600° C. to 300° C. is equal to or greater than 20° C/s; and performing tempering in a temperature range of equal to or greater than 200° C. and equal to or less than 300° C.

5. The high-strength steel plate according to claim 1 or 2, wherein a root crack ratio at a preheating temperature of 150° C. is zero when $CO_2$ welding at a heat input of 15 kJ/cm is performed.

6. The high-strength steel plate according to claim 1 or 2, wherein a ratio Hc/HE of a critical diffusible hydrogen content Hc to a diffusible hydrogen content absorbed from an environment HE is greater than 3.

7. The high-strength steel plate according to claim 1 or 2, wherein an area ratio of grains having deviational prior austenite grain size numbers Nγ not less than 3 different from a mode prior austenite grain size number Nγ corresponding to a mode class in a single field of view is less than 20%, or, in a plurality of fields of view, a difference in an average austenite grain size number Nγ between the fields of view is less than 3.

* * * * *